US008925232B2

(12) United States Patent
da Silveira

(10) Patent No.: US 8,925,232 B2
(45) Date of Patent: Jan. 6, 2015

(54) PISTOL WITH FIRING MECHANISM THAT CAN EASILY BE ADAPTED TO VARIOUS MODES OF OPERATION

(75) Inventor: Nilton da Silveira, Porto Alegre (BR)

(73) Assignee: Forjas Taurus S/A, Porto Alegre-RS (BR)

( * ) Notice: Subject to any disclaimer, the term of this patent is extended or adjusted under 35 U.S.C. 154(b) by 74 days.

(21) Appl. No.: 13/582,256

(22) PCT Filed: Jan. 15, 2010

(86) PCT No.: PCT/BR2010/000015

§ 371 (c)(1), (2), (4) Date: Aug. 31, 2012

(87) PCT Pub. No.: WO2011/085458

PCT Pub. Date: Jul. 21, 2011

(65) Prior Publication Data

US 2013/0000171 A1 Jan. 3, 2013

(51) Int. Cl.

| | |
|---|---|
| ***F41A 19/16*** | (2006.01) |
| ***F41A 19/31*** | (2006.01) |
| ***F41A 19/48*** | (2006.01) |
| ***F41A 19/15*** | (2006.01) |
| ***F41A 19/12*** | (2006.01) |
| ***F41A 19/47*** | (2006.01) |

(52) U.S. Cl.

CPC ..... *F41A 19/16* (2013.01); *F41A 19/31* (2013.01); *F41A 19/48* (2013.01); *F41A 19/15* (2013.01); *F41A 19/12* (2013.01); *F41A 19/47* (2013.01)

USPC ..... 42/69.02; 89/27.11

(58) Field of Classification Search

CPC ..... F41A 19/06; F41A 19/22; F41A 19/13; F41A 19/24; F41A 19/16; F41A 19/12; F41A 19/48; F41A 19/15; F41A 19/47; F41A 19/31

USPC ..... 42/69.01–69.03, 14, 16; 89/27.11

See application file for complete search history.

(56) References Cited

U.S. PATENT DOCUMENTS

| | | | | |
|---|---|---|---|---|
| 3,722,358 | A | 3/1973 | Seecamp | |
| 4,539,889 | A * | 9/1985 | Glock | 89/147 |
| 5,160,796 | A | 11/1992 | Tuma et al. | |
| 5,386,659 | A * | 2/1995 | Vaid et al. | 42/69.02 |
| 5,701,698 | A | 12/1997 | Wesp et al. | |

(Continued)

FOREIGN PATENT DOCUMENTS

BR 9700178 12/1998

*Primary Examiner* — Bret Hayes
*Assistant Examiner* — Joshua Freeman
(74) *Attorney, Agent, or Firm* — Volpe and Koenig, P.C.

(57) ABSTRACT

A pistol is disclosed comprising a rod, including, in an end opposite to the trigger, a tip and a crosswise arm, wherein the crosswise arm is projected from the longitudinal body of the rod, towards the pistol central portion, and includes a front surface, able to interfere with the finger, and a flap, facing the crosswise arm and projecting downwards, in the middle region having an oblong hole; a rod guiding pin, with its crosswise axle parallel to the pistol length, crosses the oblong hole, to limit the movement upwards and downwards of the crosswise arm; and a rod ramp, in the shape of an oblong laminar body, fixed to a lower end on a crosswise axle and having a fold in the opposite and upper end, projecting away from the center of the pistol, defining a contact surface that mechanically acts against the tip.

4 Claims, 15 Drawing Sheets

(56) References Cited

U.S. PATENT DOCUMENTS

| | | | | |
|---|---|---|---|---|
| 5,797,206 | A | 8/1998 | Vitorino | |
| 5,806,225 | A * | 9/1998 | Gardner et al. | 42/69.02 |
| 6,308,448 | B1 * | 10/2001 | Kapusta et al. | 42/69.02 |
| 6,354,032 | B1 * | 3/2002 | Viani | 42/69.03 |
| 6,560,909 | B2 * | 5/2003 | Cominolli | 42/70.05 |
| 7,140,141 | B2 * | 11/2006 | Vaid | 42/108 |
| 7,194,833 | B1 * | 3/2007 | Curry | 42/14 |
| 7,500,327 | B2 * | 3/2009 | Bubits | 42/69.02 |
| 7,526,889 | B2 * | 5/2009 | Metzger et al. | 42/69.03 |
| 7,690,144 | B2 * | 4/2010 | Fagundes de Campos | 42/7 |
| 2005/0011098 | A1 | 1/2005 | Fagundes de Campos | |
| 2005/0034344 | A1 * | 2/2005 | Viani | 42/69.01 |
| 2006/0248772 | A1 * | 11/2006 | Curry | 42/69.02 |
| 2006/0249014 | A1 * | 11/2006 | Curry | 89/196 |
| 2008/0263926 | A1 * | 10/2008 | Bubits | 42/69.02 |
| 2010/0236121 | A1 * | 9/2010 | McGarry | 42/69.02 |
| 2011/0289811 | A1 * | 12/2011 | Gentilini et al. | 42/69.02 |

* cited by examiner

DETALHE 03

PISTOL WITH FIRING MECHANISM THAT CAN EASILY BE ADAPTED TO VARIOUS MODES OF OPERATION

This application is a 35 U.S.C. §371 national phase application of PCT/BR2010/000015, which was filed Jan. 15, 2012 and is incorporated herein by reference as if fully set forth.

FIELD OF THE INVENTION

The present invention refers to a pistol, more specifically a pistol comprising a firing device presenting a basic configuration which is easily adaptable for in different modes.

BACKGROUND ART

The state of the art referring to fire guns, more specifically pistols, has for long incorporated various projects of firing devices, each one with its particularities. These firing devices can be divided in specific groups according to the mode of operation of the pistol, such as: single action (SA); double action (DA); or mixed (DA/SA), i.e. they can operate both in the single action mode and the double action mode, depending on the positioning of a given mechanical element of control, usually some kind of a side key on the pistol body. No matter which is the mode of operation, a common characteristic to all these pistols is the presence of a specific project and/or device for each one. However, we are unaware of a pistol or a firing device for a pistol, which optimizes its production, so as to enable the manufacture of models with different modes of operation, but with similar characteristics of operation/components.

SUMMARY OF THE INVENTION

Therefore, it is a main object of the present invention to supply a firing device for a pistol which, with a few modifications, may be converted so to operate in double action, single action and alternating double action/single action modes.

Furthermore, another object of the present invention is to provide a family or a series of pistols comprising double action pistols, single action pistols and alternate (double or single) action pistols, produced from a basic project, so as to reduce the costs of the project, production and assembly of their components and body, thus allowing an optimization of the project and therefore of the final pistols, whichever is their mode of operation.

The objects above are reached and satisfied by a basic pistol, intended to activate in the DAO mode, a pistol with a firing device which is easily adaptable to various modes of operation, comprising a frame which moves about a bolt, said frame comprising a handle, within which is housed the magazine, the trigger guard involving the trigger and a metal back support intended to house part of the components of the pistol firing device, wherein said firing device comprises said trigger, pivotably hinged to a first end of the rod, wherein the opposite end of said rod is located on the back support, and said bolt involves and houses the firing pin spring, located on the back portion and aligned with the chamber where the cartridge is located, and said bolt having, around its front portion, the spring of the firing pin, which acts over the backstop and, on its back portion, a finger projecting downwards. Said pistol also comprises a rod, in the shape of a laminar element forming and including, in said edge opposed to the trigger, a tip and a crosswise arm, wherein said crosswise arm is projected from the lengthwise body of the rod, towards the central portion of the pistol, and includes a front surface, able to mechanically interfere with said tongue, and a flap, facing the crosswise arm and projecting downwards, in the middle region of which an oblong hole is included; a rod guiding, fixed in relation to the back support, with its longitudinal axle parallel to the length of the piston, wherein said rod pin crosses the oblong hole of the flap of the crosswise arm, so as to limit the movement upwards and downwards of said crosswise arm; and a rod ramp, in the shape of an elongated laminar body, fixed by a lower end to a crosswise axle and having in the opposite and upper end a fold projecting away from the center of the pistol to define a contact surface that mechanically acts against the rod tip.

From the basic pistol above described, a pistol directed to act in the SA mode is also disclosed, which firing device also includes: a bushing, in the form of a cylinder with a central hole and located around the rod guiding pin and upstream of the flap of the crosswise arm of the rod, so as to limit the forward movement of said rod; and a rod ramp also comprising a disconnecting arm, which is vertically projected upwards and includes, in its upper end, a projection able to mechanically interfere with a rib, located on the inner side of the fixing flap where said bolt slides in, so as to displace said rod ramp inwardly in relation to the pistol.

Finally, a second alternative pistol, intended to work in the DA/SA mode, is provided, also comprising: a rod ramp also comprising a disconnecting arm, which is vertically projected upwards and includes, on its upper end, a projection able to mechanically interfere with a rib, located on the inner side of the fixing flap where said bolt slides in, so as to displace said rod ramp inwardly in relation to the pistol; a rod lock in the form of a hinge over a respective axle located parallel to the crosswise axle of the pistol, defining: a lower portion of said rod lock, having an outer surface able to be activated by a key, as well as a spring, located in the inside of said lower portion, so as to constantly push said lower portion outside, and an upper portion of the rod bolt, comprising an arm which extends parallel to the rod bolt axle, as well as a head located on the upper end of said rod bolt; and a stopper, basically in the form of a cube, provided with a central hole through which said stopper is assembled over the rod guiding pin in a position between the flap of the crosswise arm of the rod and the spring located around the rod guiding pin.

BRIEF DESCRIPTION OF DRAWINGS

The object of the present invention will be better understood in the light of the detailed disclosure below, presented as an illustration and not a limitation, with reference to the attached figures, wherein.

DETAILED DESCRIPTION OF THE INVENTION

According to the present invention, the objects are reached thanks to a firing device for a pistol with only double action (DAO), which device may be easily adapted to obtain a single action (SA) pistol and also a double/single action (DA/SA) pistol.

Figure 1:
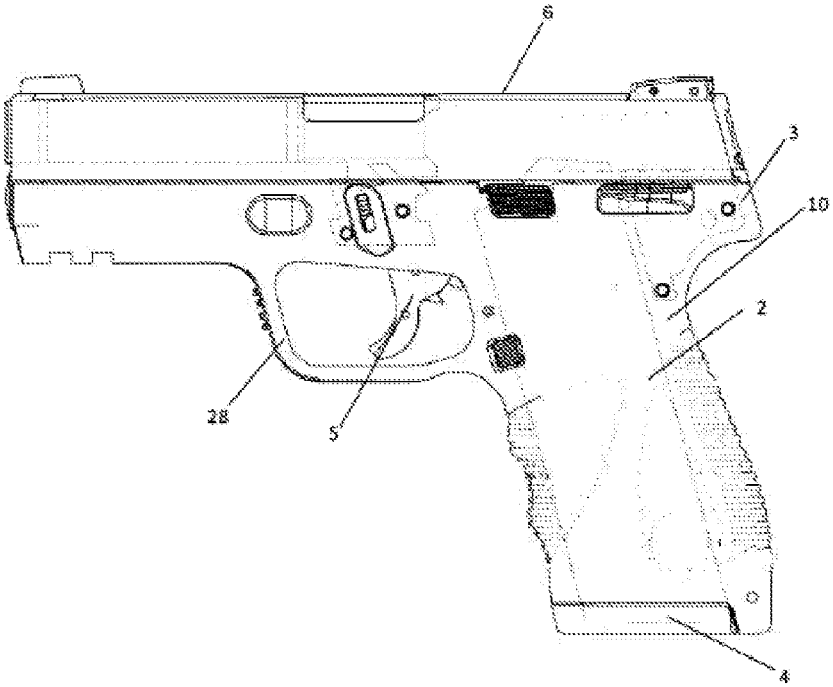
FIG. 1 is an upper side view of a pistol of the present invention, in partial section and showing its main components.

FIG. 1 is a schematic upper side view of a pistol 1 only of the double action (DAO) type, having a frame 10, including the handle 2, located on the lower back portion thereof, the lower portion of the bolt 6 and the guides (not shown) to slide said bolt 6 over the frame 10. In a preferable embodiment of the invention, the frame 10 is an injected polymeric structure provided with a few metal insertions, wherein said guides slide the bolt 6, as well as the back support 3, located above the handle 2 and intended to house part of the components of the firing device of the pistol 1, which will be disclosed in detail further below. Furthermore, the trigger guard 28 is also formed as a single part from the frame 10. Inside the handle 2, a housing is included to receive the magazine 4 intended to store and supply the cartridges 11 as known in the art.

In an advanced position in relation to the handle 2, the trigger 5 is included, which is hinged or pivoted to said frame 10 of the pistol 1 or, more specifically, said trigger 5 is hinged to the central support of the frame 10, which is a metal part housed inside the frame 10. The upper portion of the pistol comprises the bolt 6 which can slide back and forth over said frame 10, by means of said four guides (not shown), said bolt 6 in its frontal portion involves the barrel 7 and the respective return spring 8. In a rearward position in relation to the barrel 7, the chamber 9 is included in order to house a cartridge 11, which chamber is located, with the pistol 1 in a resting position, in a lengthwise position equal to the trigger 5. Furthermore, the back portion of the bolt 6 covers the firing pin 12 and the respective spring of the firing pin spring 13.

More specifically, FIGS. 2 to 10, showing schematic views of the firing device for the pistol 1 operated only in the double action (DAO) mode, show components of the firing device, with parts removed not to compromise the clarity of the figures.

Therefore, the trigger 5, hinged to said central support of the frame 10, is hinged mounted to the rod 14, so that the movements made by the trigger 5 are transferred to the rod 14 and vice versa. Said rod 14 has the shape of a conformed laminar element and includes, on its end opposite to the trigger 5, a tip 16 and a crosswise arm 17. More specifically, the crosswise arm 17 is projected from the longitudinal body of the rod 14 towards the central portion of the pistol 1, and has a front surface 18, able to mechanically interact with a finger 24 projected from the firing pin 12 and a flap 19 facing the crosswise arm 17 and projected downwards, in the central portion where an oblong hole 20 is provided, where the rod guiding pin 21 is included. The rod guiding pin 21 is fixed to said metal back support of the frame 10 and is intended to limit the upward and downward movement of the rod 14, but not to limit its back and forth movement.

Said tip 16 of the rod 14 acts against the rod ramp 30 which, on a lower end, is fixed to a crosswise axle 22 and, on the opposite and upper end, has a fold projecting away from the center of the pistol 1, thus defining a contact surface with the tip 16 of the rod 14.

As stated, the firing pin 12 is located inside the region as limited by the bolt 6 and is able to move freely, back and forth, in relation to said bolt 6. More particularly, the firing pin 12 has a cylindrical shape, provided with a tip 23 in its front portion for the percussion of the cartridge 11, and having in its rear portion a finger 24, which forms a ramp 27 on its lower back portion, intended to mechanically interact with the crosswise arm 17 of the rod 14. Furthermore, around the central portion of the firing pin 12, said firing pin spring 13 is located.

A few other details of the above components, as well as the form of operation of the device of the present invention in the double action mode of operation, will now be particularly explained based on FIGS. 2 to 10.

Figure 2:
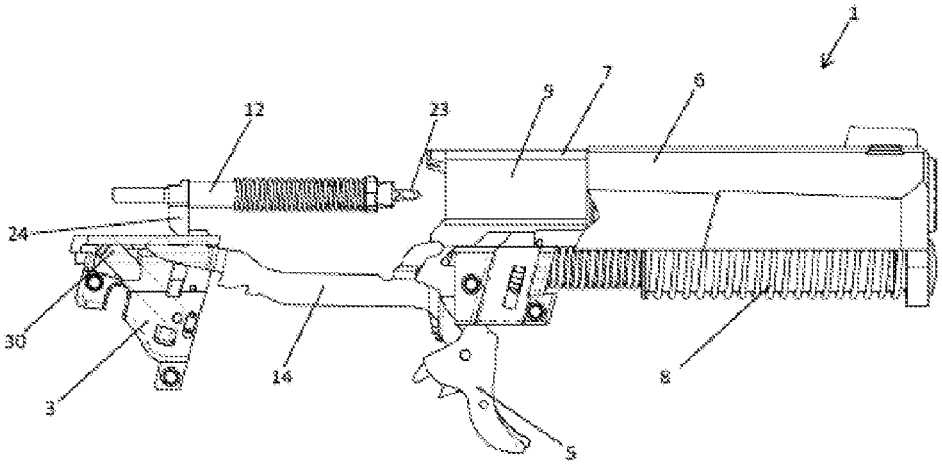
FIGS. 2 to 10 are schematic views showing a pistol with DAO mode of operation, in partial section and corresponding to the various steps of operation of this embodiment of the invention.

On FIG. 2 (and also 10), the pistol 1 is loaded, i.e. it has a cartridge 11 in the respective chamber 9 with the magazine 4 loaded, as well as a trigger in starting course, i.e. in its most advanced position. Therefore, the user starts the firing procedure by moving the trigger 5 backwards, causing the movement of the rod 14 in the same direction. Such movement of the rod 14 is guided by the rod guiding pin 21, so as to guarantee that said rod 14 is not displaced upwards. Consequently, and due to the mechanical interference between the front surface 18 of the crosswise arm 17 of the rod 14 with the finger 24 of the firing pin 12, said firing pin 12 will also be moved backwards against the resistance as imposed by the firing pin spring 13, as shown by FIG. 2.

Figure 3:
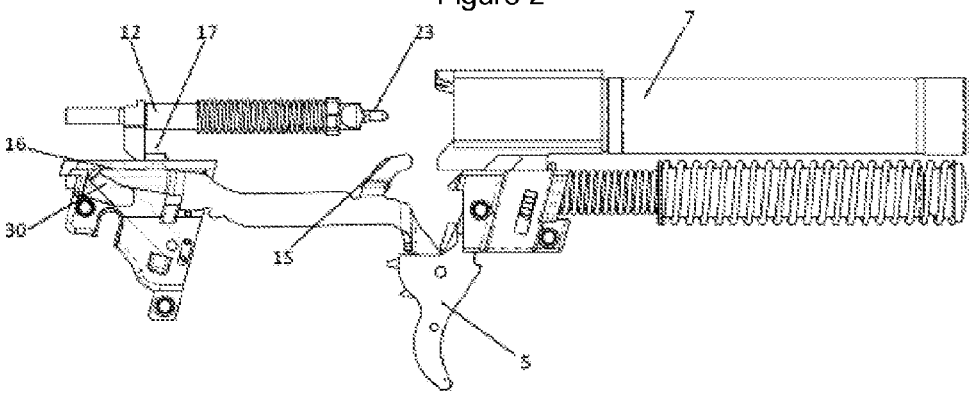
Figure 3A:
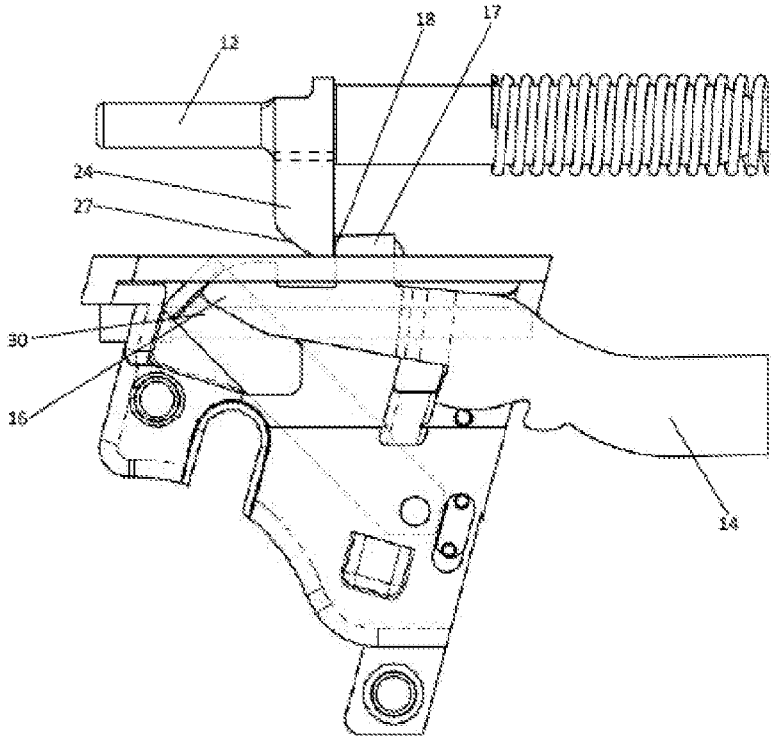

That same position is shown by FIG. 3 in its respective enlarged detail (DET 3), which is an enlarged view of the back support 3 of the pistol 1, from which we can notice that, in that point of the movement, the tip 16 of the rod 14 comes into contact with the rod ramp 30, thus forcing said rod 14 downwards and therefore lowering the crosswise arm 17 until the release of the finger 24 of the firing pin 12.

Figure 4:
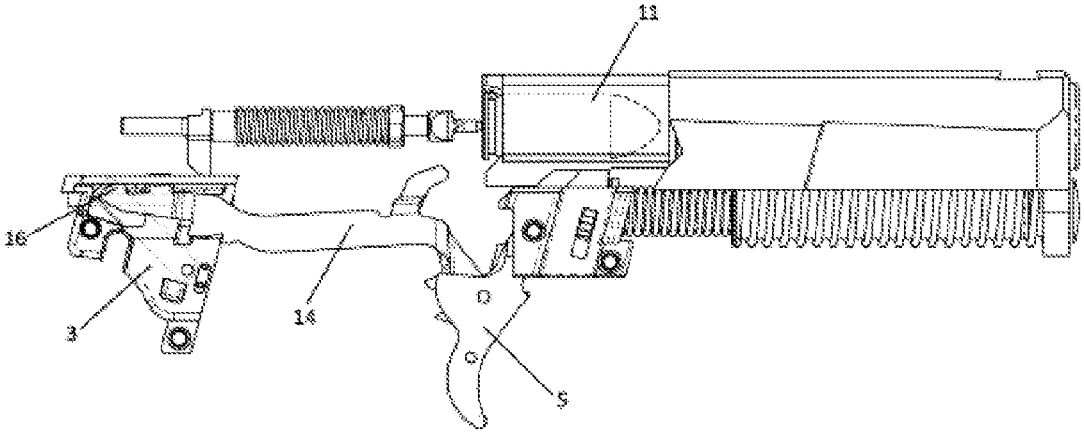
Figure 5:
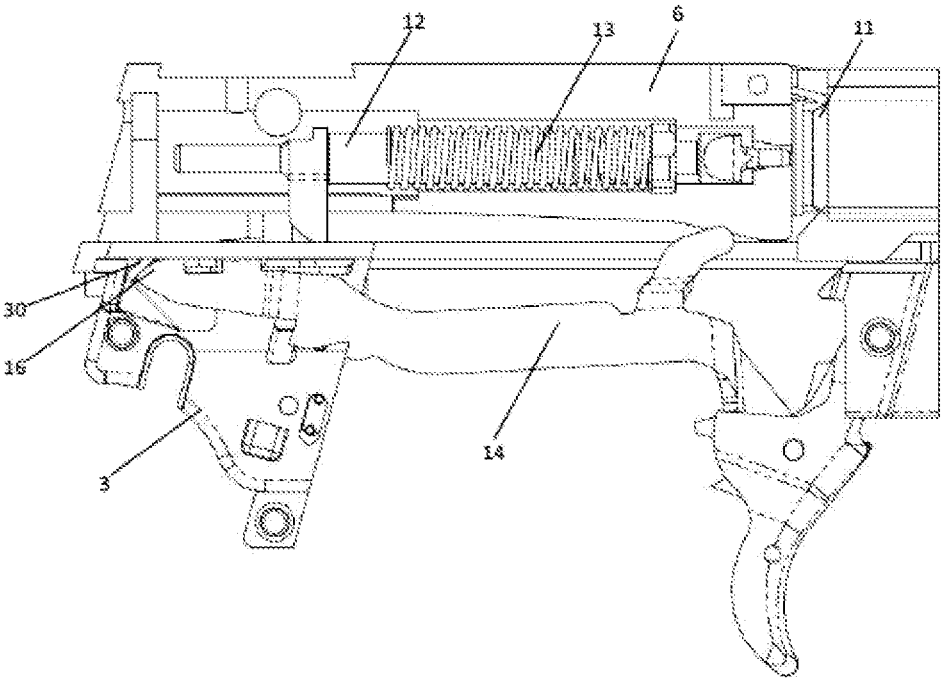

At that moment, i.e. when the crosswise arm 17 no longer works against the finger 24 of the firing pin, said firing pin 12 is pushed frontwards by the action of the firing pin spring 13, causing the percussion of the ammunition located inside the chamber 9 of the barrel 7 through its tip 23. Particularly, FIGS. 4 and 5 show the moment of the percussion of the cartridge 11, where we can see the rod 14 in its lowest position and the finger 24 of the firing pin in an advanced position in relation the crosswise arm 17 of the rod 14.

From this point, the so-called cycling starts, i.e. the procedure to eliminate the fired cartridge, reload the chamber with a new cartridge and reposition the firing device for new firing. Said sequence of events is shown, step by step, on FIGS. 6 to 10.

Figure 6:
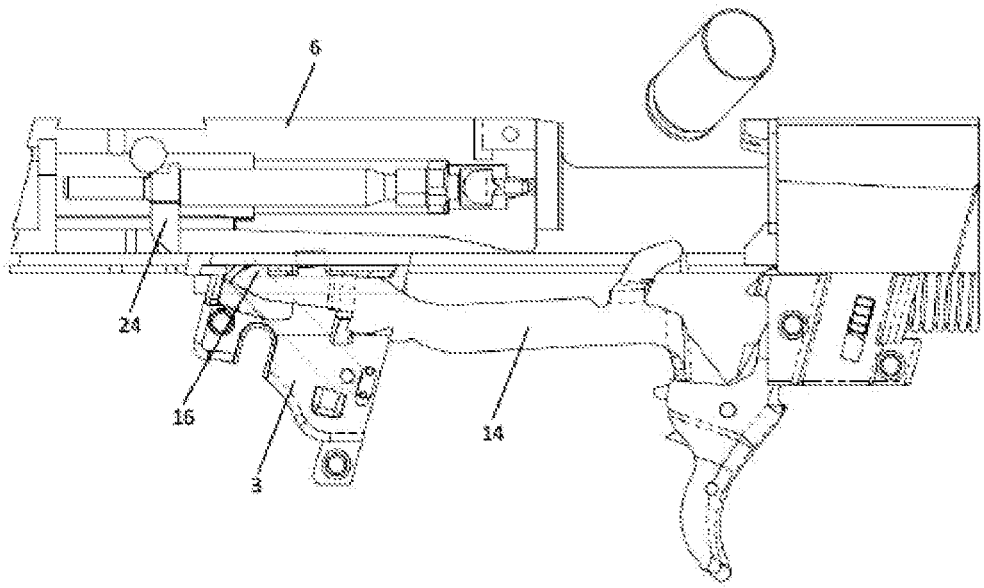
Figure 10:
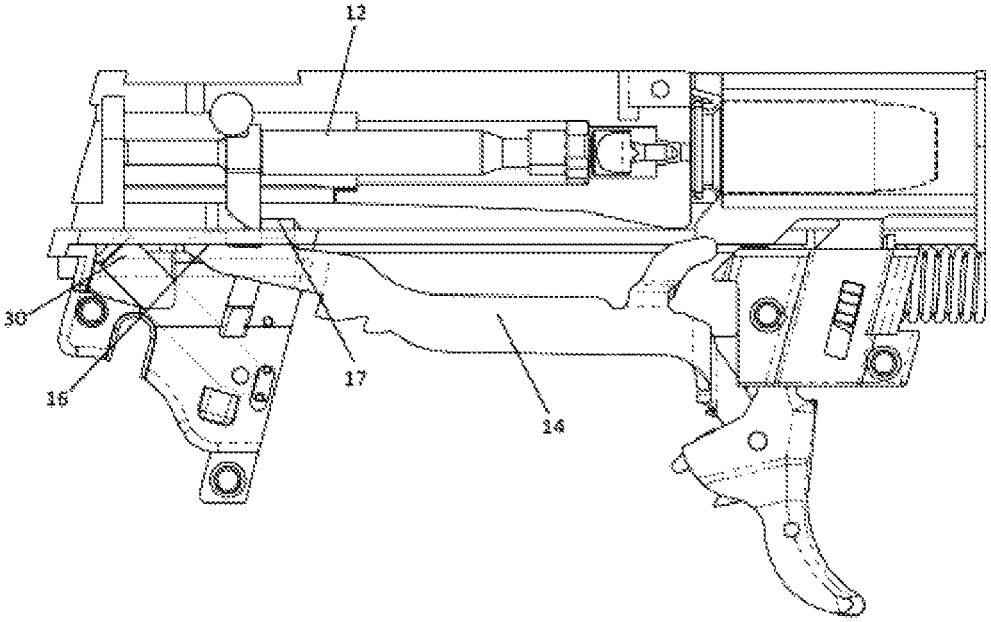

Therefore, after the firing and during bolt 6 cycling, caused by the gas expansion in the cartridge, the firing pin 12 follows backwards together with the bolt 6 (please see FIG. 6—maximum backwards position of the bolt). After the bolt ends the quick clicking process, supplying the chamber 9 and returning to the front, the user starts to release the trigger 5, causing the rod 14 of the trigger to follow said forward movement (please see FIG. 7). During the movement of the rod 14 backwards, its crosswise arm 17 hits the ramp 27 of the finger 24, thus forcing said rod 14 downwards (please FIGS. 8 and 9). This movement downwards is limited by the rod guide pin 21, until the crosswise arm 17 is facing the finger 24, going up and again locking the bolt 6, i.e. taking a similar position to the initial position as shown by FIGS. 10 and 2. Therefore, the device is fully in its initial position and, at that moment, the user may fire a new shot. We should also highlight that, as an inherent characteristic of the DA activating system for the pistol 1, the trigger 5 returns to its initially more advanced position which, to fire a new shot, should be pulled all the back by the user, repeating the above disclosed steps.

A second embodiment of the present invention comprises a pistol 40, such as shown by FIGS. 11 to 20, relative to the various steps of the firing procedure in SA mode and wherein numerical references similar to those used for FIGS. 2 to 10 show equal components. This embodiment basically shows two differences over the previously disclosed one, i.e. the presence of the bushing 42 and a disconnecting arm 43 projecting from the rod ramp 30'.

Figure 11:
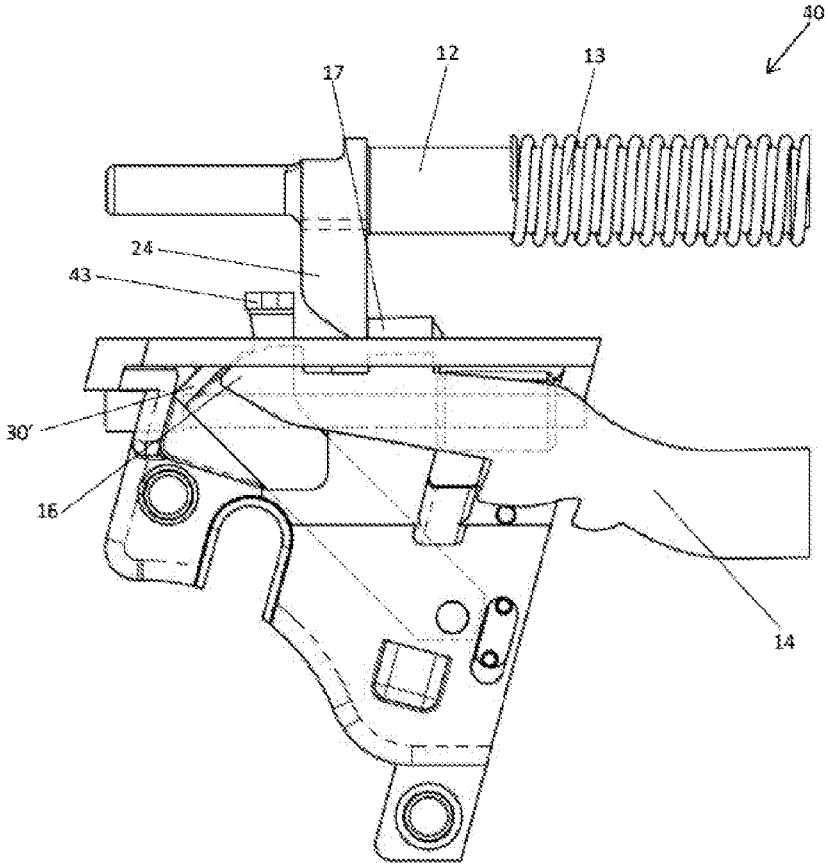
FIGS. 11 to 20 are schematic views showing a firing device for a pistol of the present invention, only operated in the single action mode, with the switched device in relation to the basic firing device shown by FIGS. 2 to 10.

More particularly, and with specific reference to FIG. 11, 42 shows a bushing which is located around the guide pin 21 of the rod 14 working so as to limit the range of displacement of the flap 19 of the crosswise arm 17 of the rod 14, thus preventing said rod 14 from advancing beyond a given point.

Figure 14:
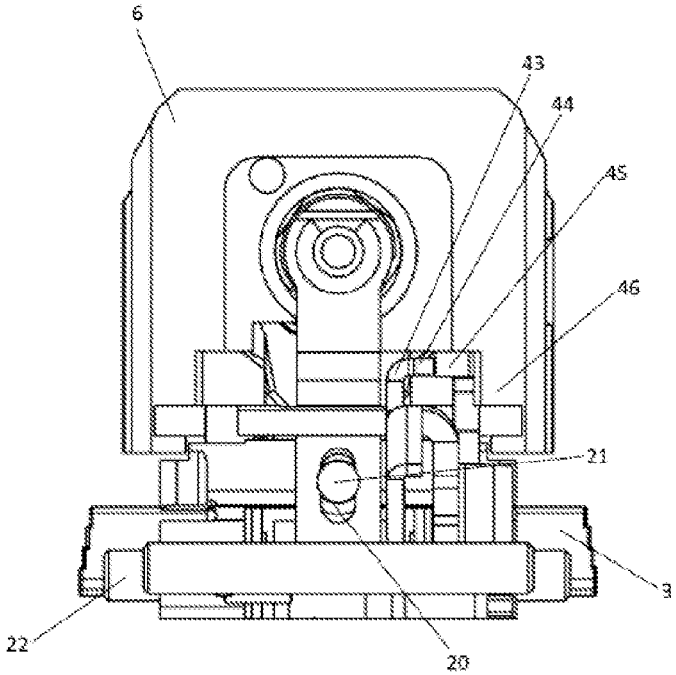
Figure 12:
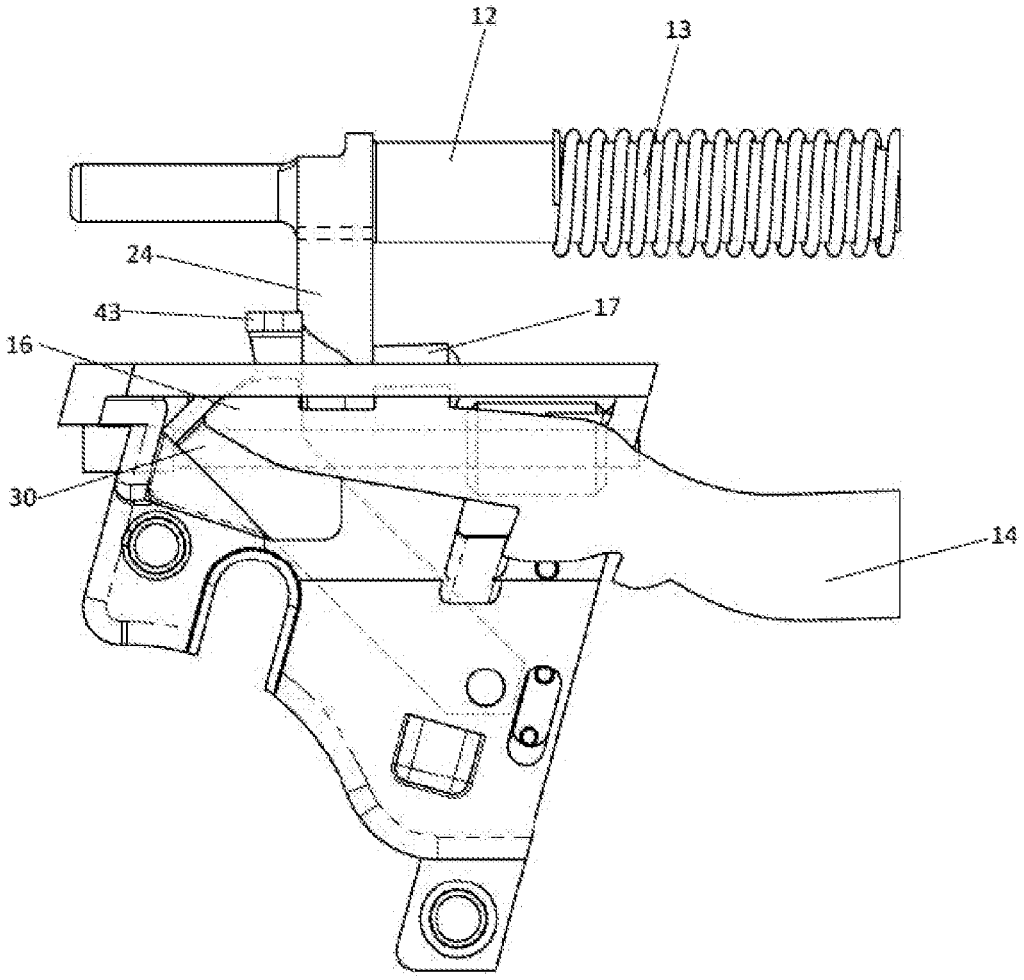
Figure 15:
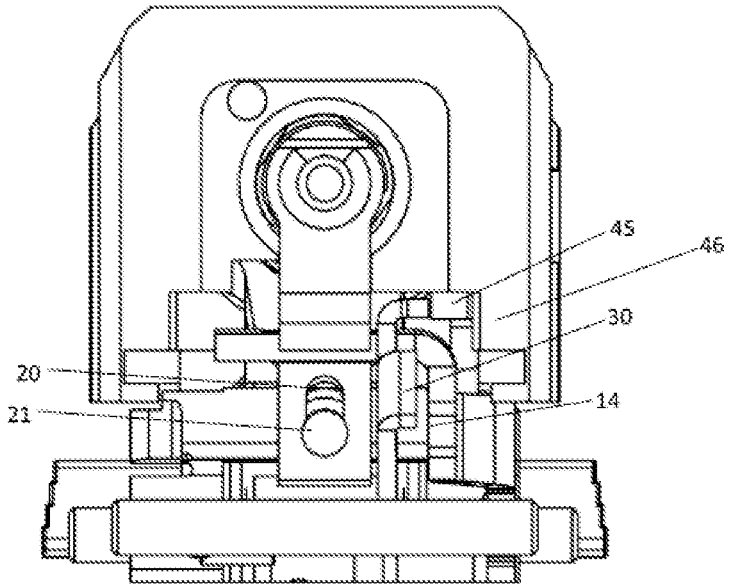
Figure 13:
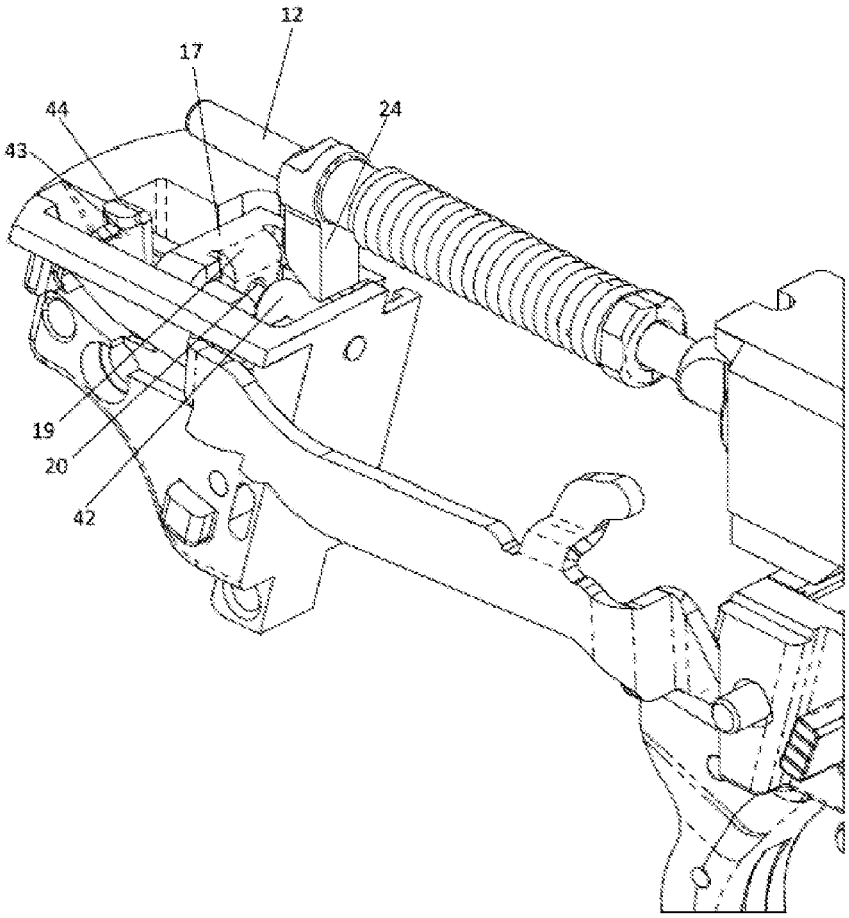

As stated, the other change as introduced in this embodiment of the invention relates to the rod ramp 30', which presents a disconnecting arm 43 projecting upwards and having, on its upper end, a projection 44 able to interact with the bolt. More specifically, FIGS. 14 and 15 are schematic upper rear views wherein the rib 45 of the bolt 6, located in the inner side of the fixing flap 46 wherein said bolt 6 slides can be identified.

Therefore, FIG. 11 is a perspective view of the back portion of the pistol 40, in an equivalent moment as shown by FIG. 3 above, i.e. with the trigger 5 being pulled backward by the action of the user of the pistol 40. Also in this case, the rod 14 moves backwards and is lowered by the action of the tip 16 under the ramp 30' (please refer to FIG. 12 for a similar view to FIG. 11 with the rod 14 almost fully lowered). Simultaneously, the crosswise arm 17 is also lowered until the physical contact between the front surface 18 of the crosswise arm 17 and the finger 24 of the firing pin 12 is lost. At that moment, the firing pin 12 is released and hits the cartridge 11 (please refer to FIG. 13, relative to a perspective view showing the moment of firing the gun 30'), similarly to the disclosures on the above embodiment. As a result of this shot, the bolt 6 returns to its maximum backwards position, releases the fired cartridge 11 and inserts a new cartridge in the chamber 9, just as disclosed and known in the art.

However, with the return of the bolt 6, said bolt rib 45 acts over the upper projection 44 of the disconnecting arm 43 of the rod ramp 30', causing its displacement to the center of the gun and loss of contact with the tip 16 of the rod 14. More particularly, FIGS. 14 and 15 are schematic upper end views showing two consecutive moments during the backwards movement of the bolt 6, respectively with the rod 14 in an intermediate position (FIG. 14) and later in a fully upper position (FIG. 15). As we can see, from the displacement into the rod ramp 30', the tip 16 loses contact with the rod ramp 30' and is pushed upwards (we remind that, at this point, the trigger 5 is still pulled backwards by the user, thus forcing the rod 14 backwards).

Figure 7:
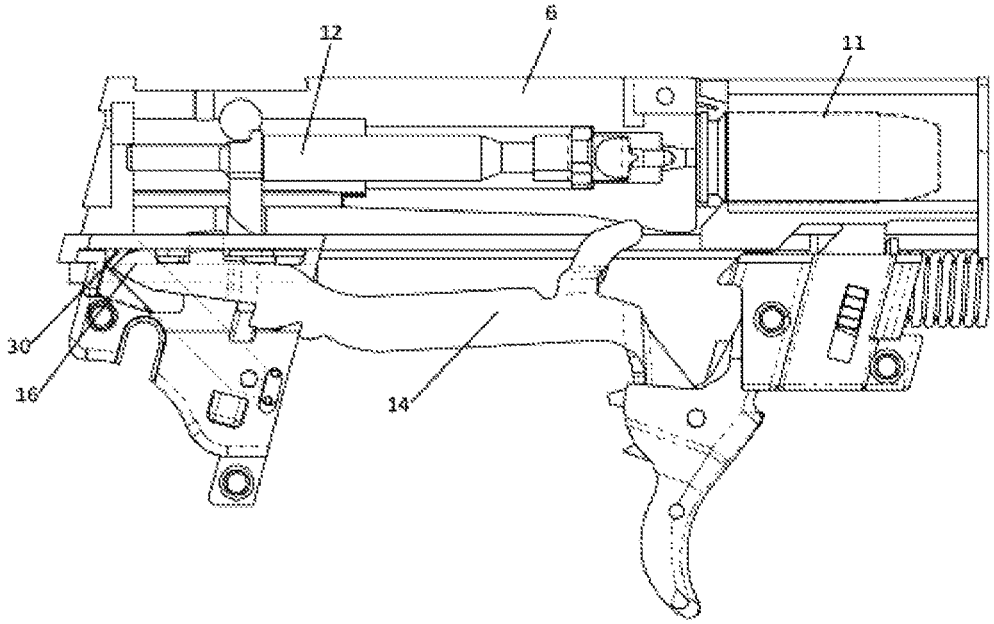
Figure 8:
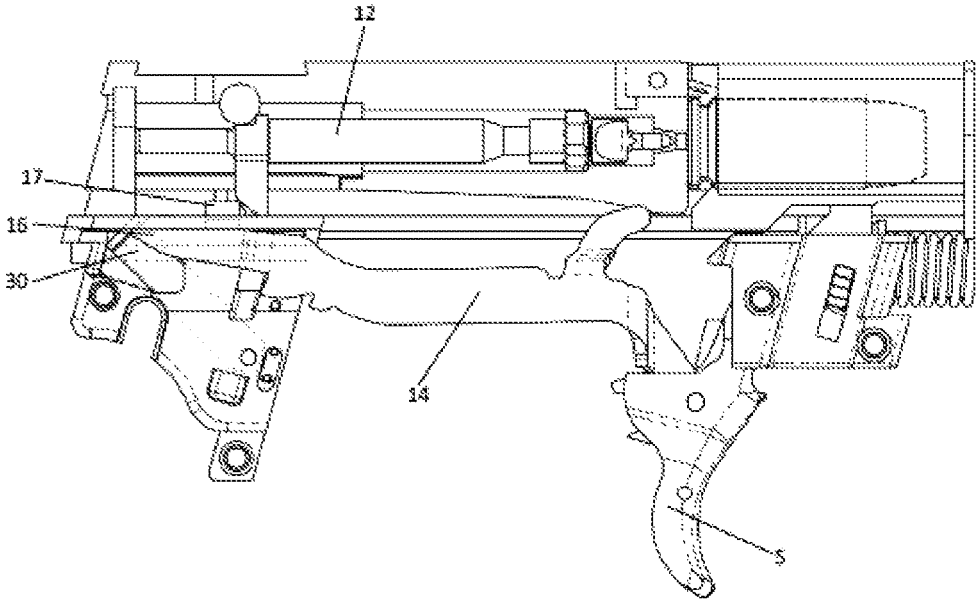
Figure 9:
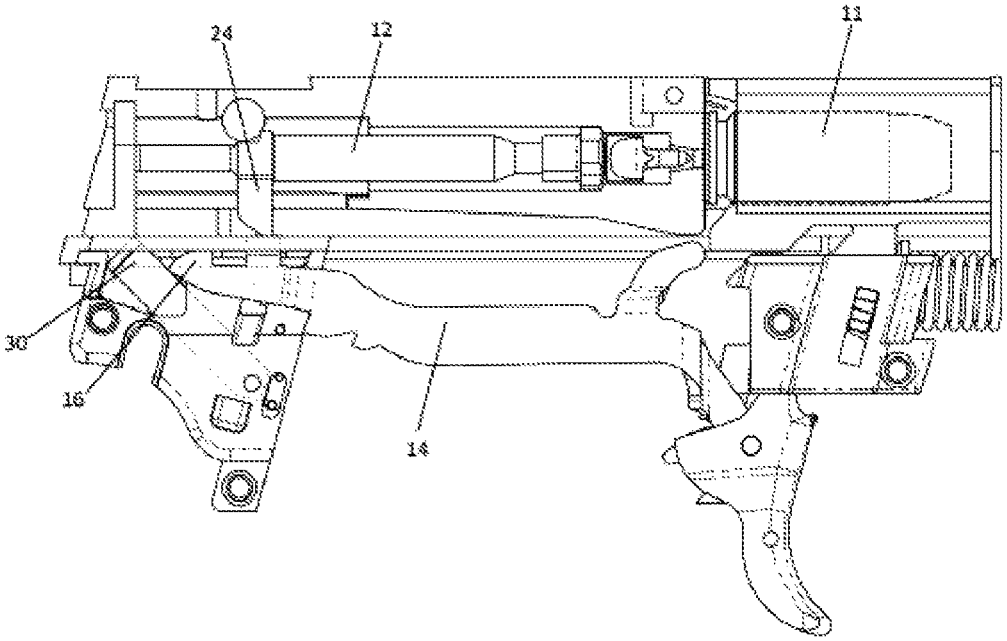

FIGS. 16 to 19 are upper side views showing the return of the bolt 6 from its maximum backwards position to its resting or initial position. Therefore, due to the upper position of the rod 14, the finger 24 of the firing pin 12 hits the front surface 18 of the crosswise arm 17, and therefore cannot move forward. Said blocking effected on the rod 14 is also the result of the presence of the bushing 42 which, as stated, prevents the crosswise arm 17 of the rod 14 from moving forward (please see FIG. 17). Just as a comparison, FIG. 7 shows the return of the bolt 6 and the firing pin 12, which is possible due to the lowered position of the rod 14 and particularly its crosswise arm 17, allowing the finger 24 of the firing pin 12 to pass over a crosswise arm 17 with no mechanical interference between them.

Figure 20:
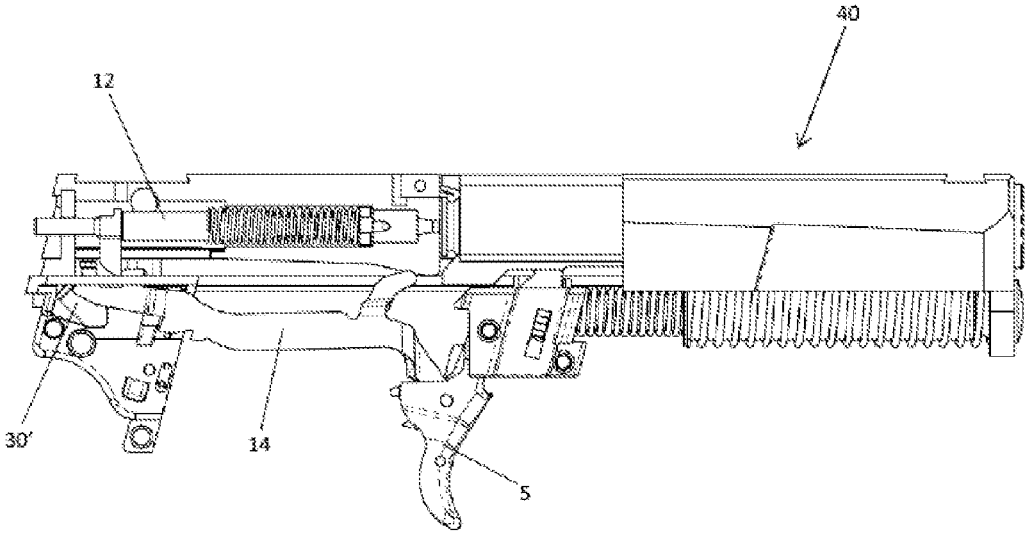
Figure 16:
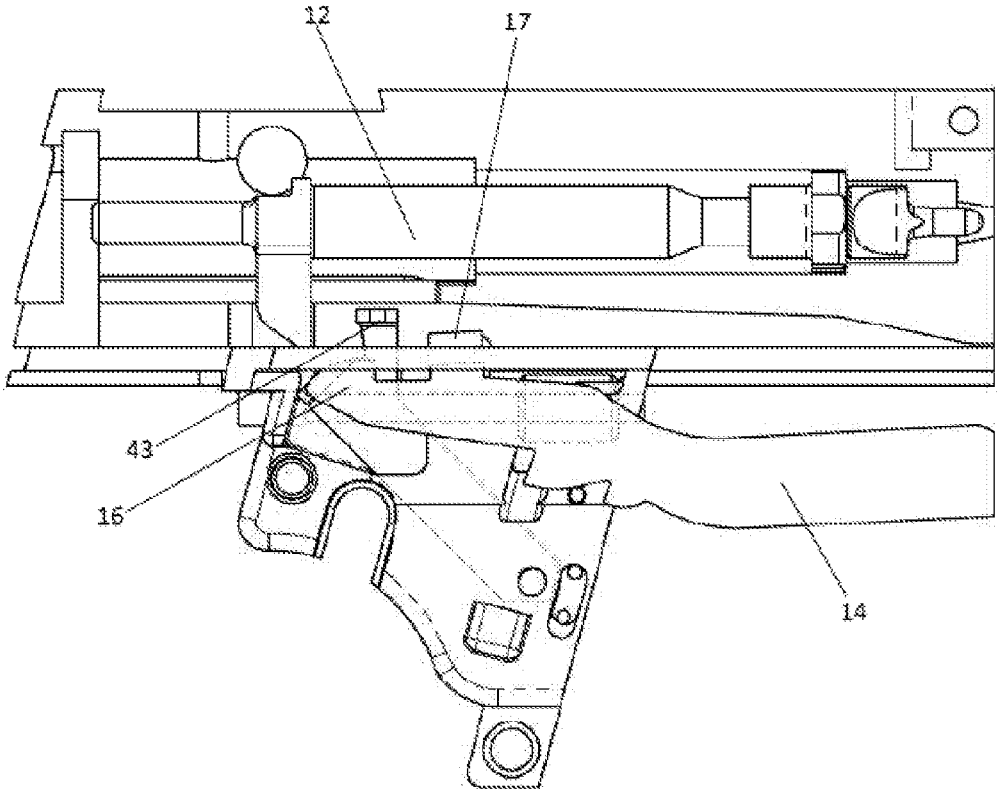
Figure 17:
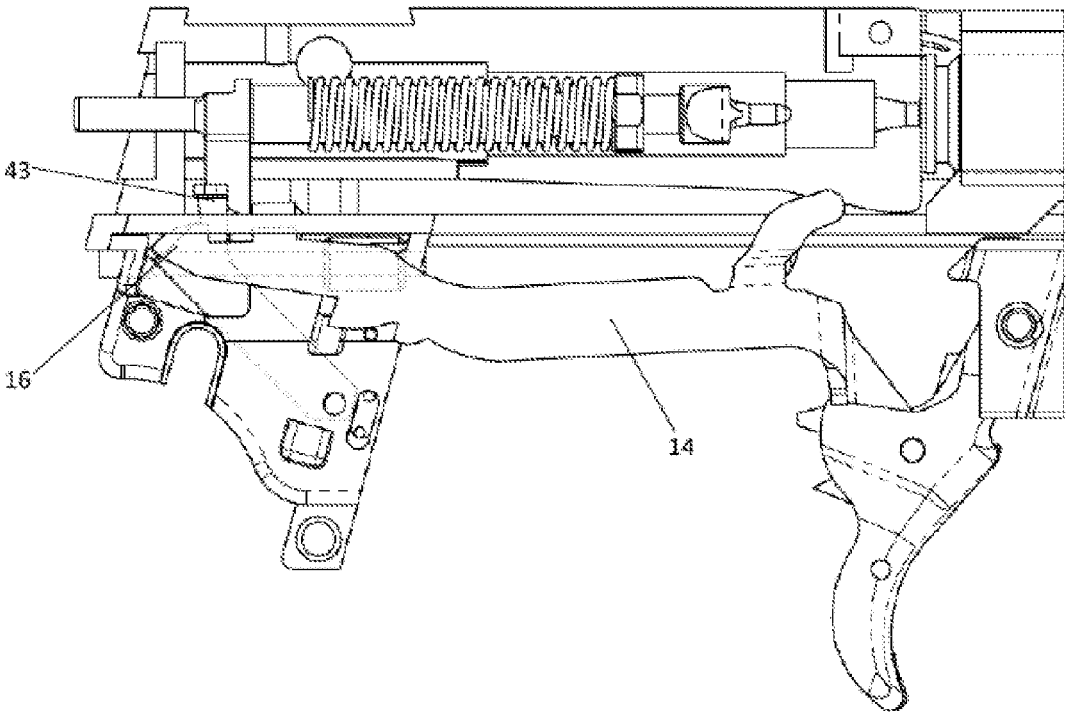
Figure 18:
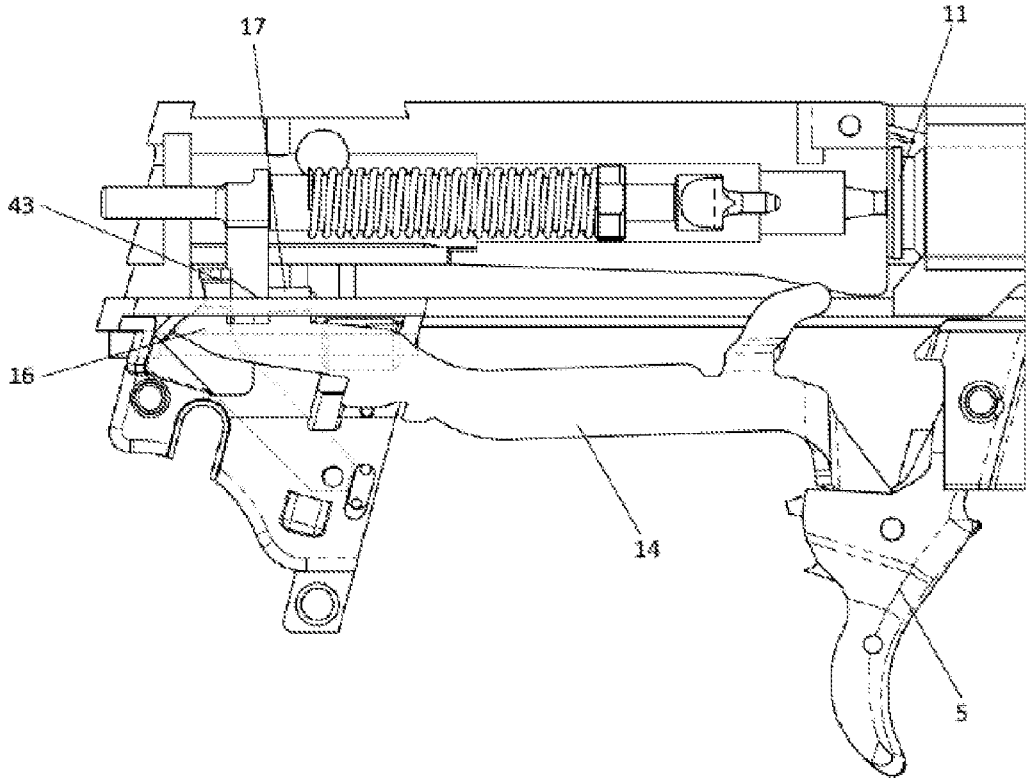
Figure 19:
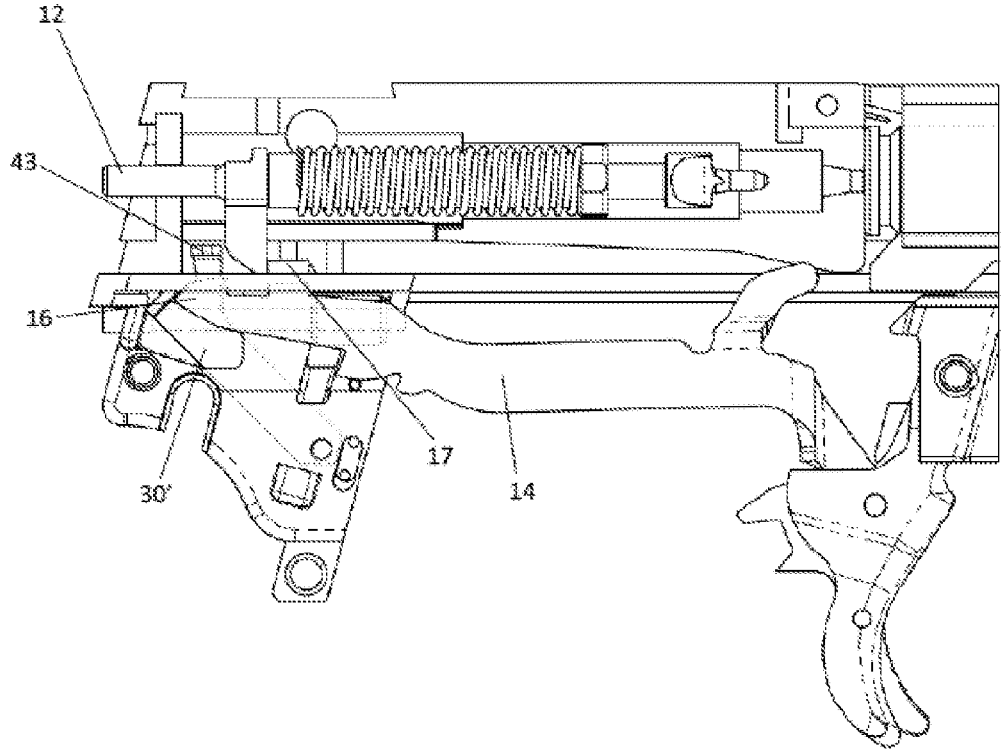

In this case, as well as in the definition of the firing SA system, the firing pin can only return to its advanced position when the user releases the trigger 5 so it can return to its operational position in SA. More specifically, FIGS. 18 and 19 show intermediate return positions for the trigger 5 to its operational position in SA, with the corresponding return of the rod 14, and FIG. 20 shows the pistol 40 in its final position. As we can see, the firing pin 12 gradually returns to its position just as the trigger 5 is released by the user. The finger 24 of the firing pin 12 remains in contact with the crosswise arm 17 during the whole displacement of the rod 14, remaining in this position until a new shot is fired. We should highlight that, in the operational position as shown by FIG. 20, the trigger 5 and the rod 14 remain in an intermediate position between the initial position of the pistol 40 (FIG. 11) and the firing position of the gun. Said effect is due to the presence of the bushing 42 limiting the return path of the rod 14 and therefore the trigger 5. In the following shot, the user will need to move the trigger 5 through a shorter path to release the firing pin 12 and fire the cartridge 11, i.e. eliminating the whole initial step of movement backwards of the rod to engage the finger 24 of the firing pin 12, just like in the DA operation mode.

We should also highlight that, during the return of the firing pin to its initial advanced position, the bolt has already returned to its respective advanced position and, therefore, the bolt rib 45 of the flap 46 no longer acts on the upper projection 44 of the disconnecting arm 43 of the rod ramp 30, and therefore the tip 16 of the rod 14 is again in contact with said rod ramp 30.

As previously stated, the differences existing between the SA embodiment (FIGS. 11 to 20) and the DAO embodiment are limited to the inclusion of the bushing 42 and the disconnecting arm 43. The bolt rib 45 is also present in the DAO embodiment, but said bolt rib 45 does not act on the rod ramp 30 due to the non-existence of said disconnecting arm 43 and the respective projection 44. Said solution allows to reach the objects of maximum standardization of the production line, whichever is the model of pistol to be produced, i.e. reducing at maximum the differences and particularities between them.

Anyway, the simple and efficient inclusion of the bushing 42 and the disconnecting arm 43 allows changing both the course of displacement and the position of the crosswise arm 17, and therefore the whole rod 14. Therefore, and after the return of the bolt 6, the firing pin can no longer advance freely, since it is blocked by the crosswise arm 17, now located in a backward upper position, thus interfering with the return path of the finger 24 of the firing pin 12.

We will now disclose the last embodiment of the present invention, as specifically shown by FIGS. 21 to 28, wherein numeric references similar to those used for FIGS. 1 to 20 show equivalent components. Particularly, the firing device of this embodiment of the pistol allows its use in both DA and SA modes, depending on the circumstances.

As preliminarily seen, in order for the basic device of the SA pistol at issue, acting in DAO mode, to be built so as to be altered to work in SA mode, the bushing 42 must be included in the rod guiding pin 21, to avoid the free movement forward of the rod 14 when the bolt 6 returning, and also by the inclusion disconnecting arm 43, relative to the rod ramp 30' and mechanically activated by the bolt 6.

In the present DA/SA mode of actuation, the pistol 50 must be able to work in the DA mode and in the SA mode. More specifically, said DA/SA actuation form is defined by a first shot in DA mode and by consecutive shots in SA mode, until the user returns the pistol 50 to the DA mode of firing, by voluntarily activating the external key or in the case of an involuntary firing failure. For that purpose, the inventor has devised a firing device wherein a mobile element is included, to work like the bushing 42 in the SA mode pistol 40, but which can also be displaced from its blocking position, thus allowing the pistol 50 to also work in DA mode.

Therefore, and in comparison with the firing device of the DA mode pistol 1, the enhancements of the present embodiment are both the disconnecting arm 43 of the rod ramp 30', with its respective upper projection 44 (just like shown and disclosed in the embodiment of the SA mode pistol 40), as well as a rod lock 51 and a respective stopper 52 for the rod lock 51.

Figure 21:
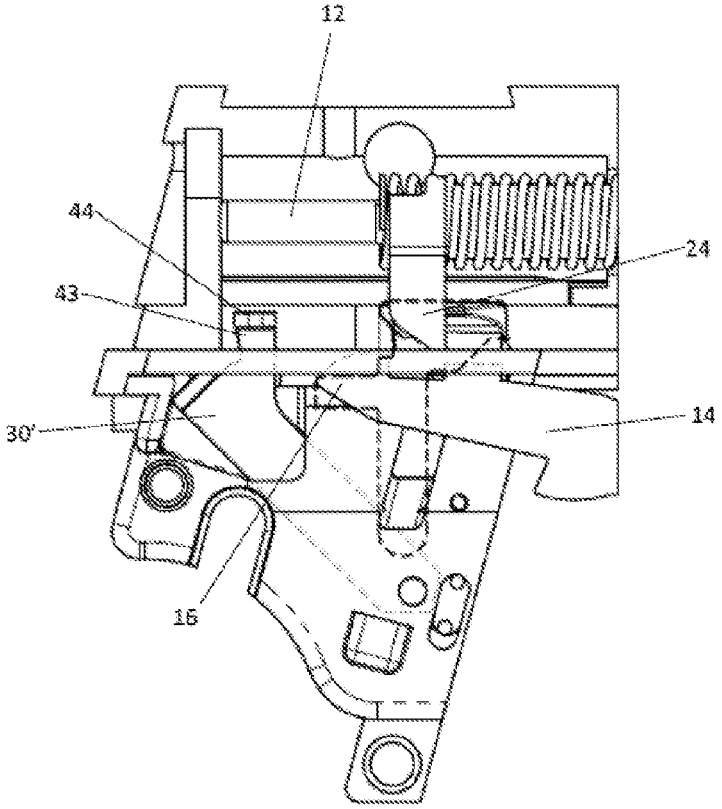
FIGS. 21 to 28 are schematic views showing a firing device for a pistol of the present invention, operated in the double action/single action mode.

Therefore, FIG. 21 is an upper view in partial section of the back portion of the pistol 50, according to an embodiment of the present invention, in its resting position, while FIGS. 22 to 28 correspond to the various steps to activate the pistol 50, after starting to activate the trigger 5.

Specifically, FIG. 21 initially highlights the presence of the disconnecting arm 43, which has, on its upper end, an upper projection 44, i.e. exactly the same as the disconnecting arm 43 as shown by FIGS. 11 to 20 for the pistol 40. We should also highlight that the form of activation of the disconnecting arm 43 is exactly the same as the corresponding disconnecting arm 43 of the pistol 40, including with reference to its interaction with the bolt rib 45 present on the flap 46 of the bolt 6.

Figure 23:
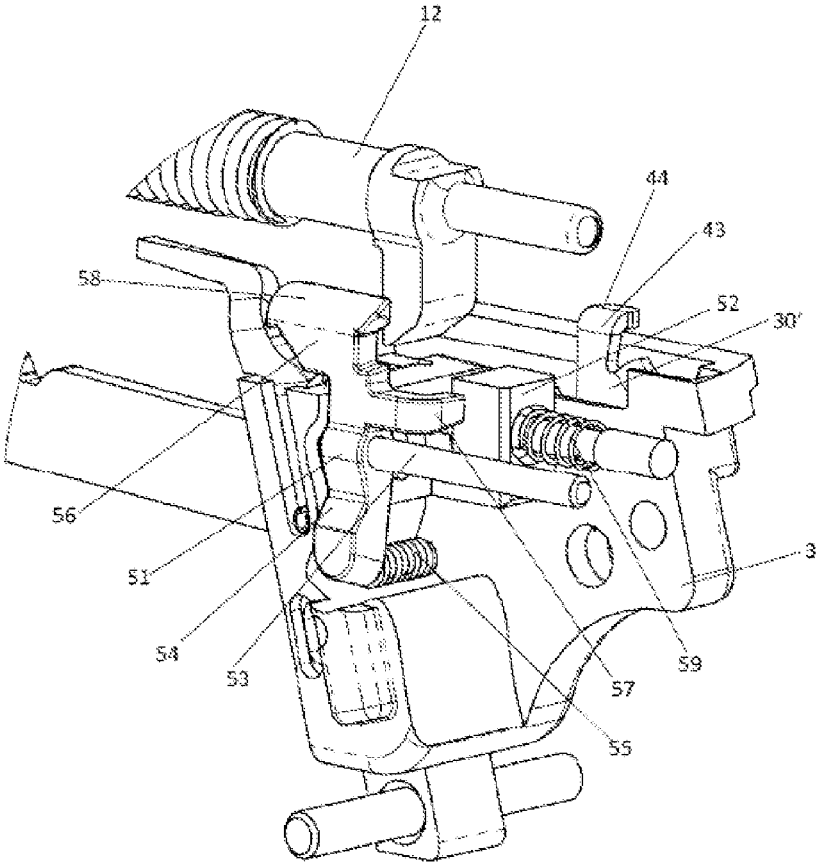

Furthermore, and as a specific innovation for this embodiment of the invention, the pistol 50 of the DA/SA mode also comprises the rod lock 51 and a respective stopper 52 (please refer specifically to FIG. 23). Particularly, the rod lock 51 has the shape of a hinge to a respective axle 53 located parallel to the crosswise axle of the pistol 50. The lower portion 54 or arm of said rod lock 51 has an external surface able to be activated by a key (not shown) fixed to the rear side of the pistol 50, said key may be activated by the user as we will see in the description of the operation of the pistol 50 further below. Furthermore, said lower portion 54 of the rod lock 51 is constantly pushed out by the action of the spring 55, for which reason the upper portion 56 or arm of the rod lock 51 is correspondingly pushed inside, always in relation to the body of the pistol 50. The upper portion 56 of the rod lock 51 comprises an arm 57 which extends parallel to the axle 53 of the rod lock 51, as well as a head 58 located at the upper end of said rod lock 51.

The stopper 52 is also included, presenting basically the shape of a cube, provided with a central hole (please refer to FIG. 25) through which said stopper 52 is assembled over the rod guiding pin 21. Furthermore, and around the rod guiding pin 21, the spring 59 is located, to push said stopper 52 forward. The stopper 52 is unable to spin around said rod guiding pin 21, since its housing in the back support 3 does not allow its angular movement. On the other hand, said stopper 52 may be displaced lengthwise, and its maximum advance position is limited by the flap 19 of the crosswise arm 17 of the rod 14.

Concerning the rod lock 51 and, more specifically, the arm 57 of said rod lock 51, the stopper 52 may assume two possible positions. The first one, as shown by FIG. 23, is the maximum advanced position of the stopper 52, in which the arm 57 of the rod lock 51 is supported by the side of the rod lock 51, being therefore forced out against the action of the spring 55, being said position of the rod lock 51 called "open" herein. The second position, just like better shown by FIGS. 24 and 25, i.e. the maximum backward position of the stopper 52, is the position in which the stopper 52 loses contact with the arm 57 of the rod lock 51 and is kept in recess against the action of the spring 59 located around the rod guiding pin 21. In that position, and since the arm 57 of the rod lock 51 loses contact with the stopper 52, the spring 55 acts on the lower portion 54 of the rod lock 51, causing the head 58 to be displaced to inside the pistol 50 and, more specifically, interfering with the displacement of the flap 19 of the crosswise arm 17 of the rod 14, wherein said position of the rod lock 51 is herein called "closed". Particularly, we should highlight that, in a closed position, the head 58 of the rod lock 51 takes the same position of the bushing 42 of the firing device of the pistol 40, i.e. it interferes with the advance movement of said rod 14.

The inter-relationship between these components and the other components as common to all embodiments of the pistols 1, 40 and 50 of the present invention will be clearer from the following description, relative to various steps when the pistol 50 is fired.

Therefore, we start from the initial position as shown by FIG. 21, wherein the pistol 50 is ready to fire, with the trigger 5 in its extended resting position and the rod 14 also in its maximum extended position and interacting with the finger 24 of the firing pin 12.

Figure 22:
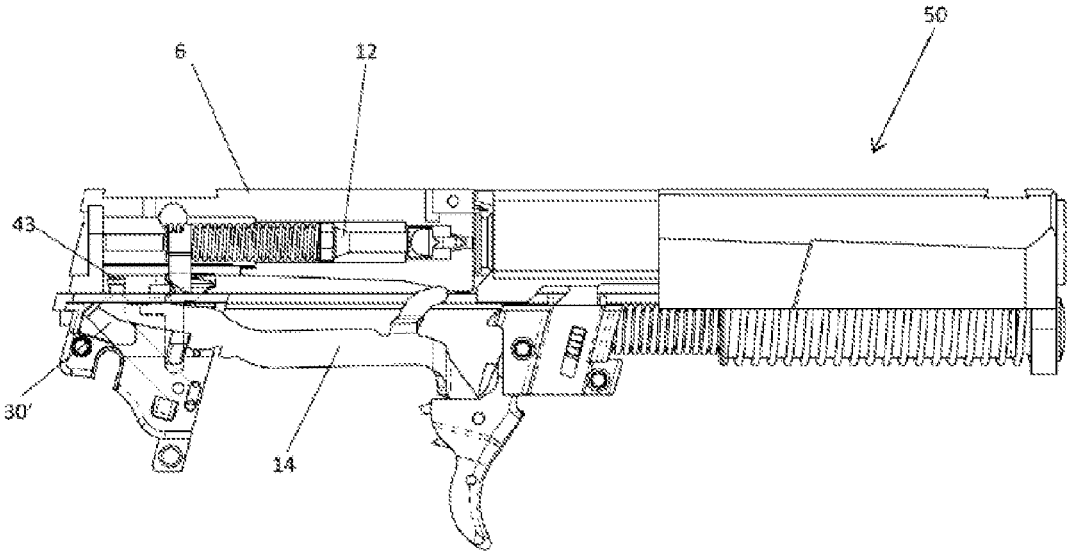

Just like in the previous embodiments, FIG. 22 is a schematic view in perspective with the trigger 5 in an intermediate position, i.e. between the initial and the final firing position. In that moment, the tip 16 abuts the rod ramp 30' during its return movement and is forced downwards due to that interaction with the rod ramp 30'.

Figure 24:
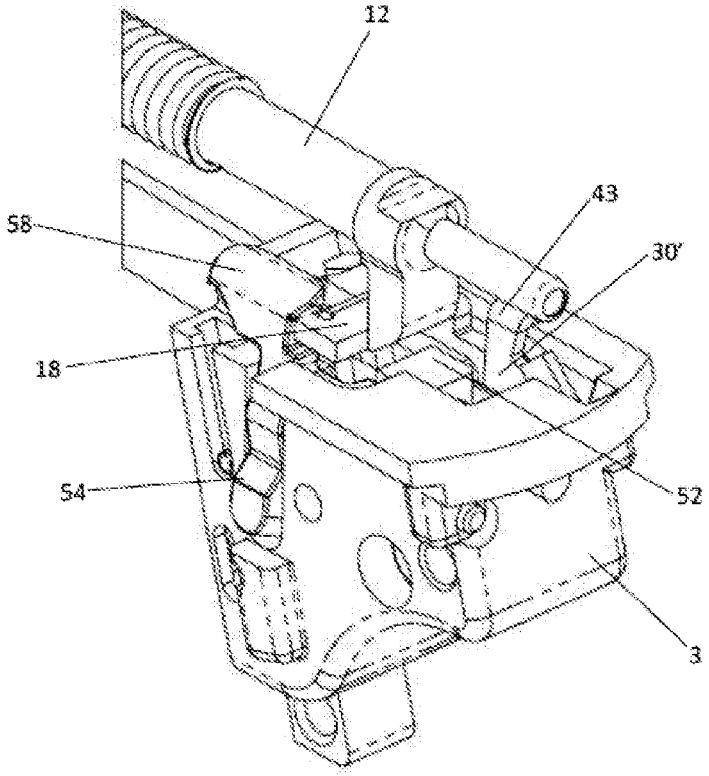
Figure 25:
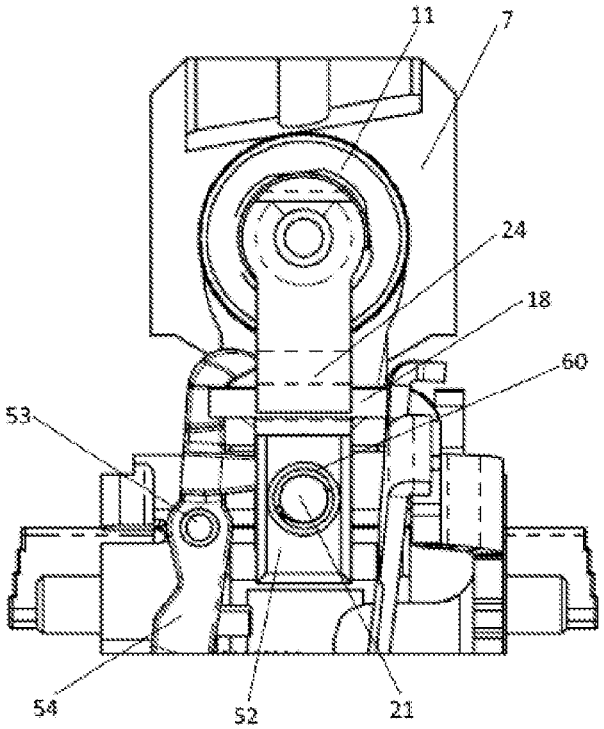

FIGS. 23 and 24 are schematic perspective views in partial section showing the left side of the pistol 50, i.e. the side where the rod lock 51 is positioned, in two consecutive moments. FIG. 25 is an upper end view with the pistol 50 in the same situation as shown by FIG. 24, i.e. shortly before firing. From those figures, we can see that, by retracting the rod 14, the stopper 52 is pushed back by the retraction movement of the flap 19 of the crosswise arm 17 of the rod 14, causing the arm 57 of the rod lock 51 to no longer abut the side surface of the stopper 52, and thus the rod lock 51 switches from the open position (FIG. 23) to a closed position (FIGS. 24 and 25).

Figure 26:
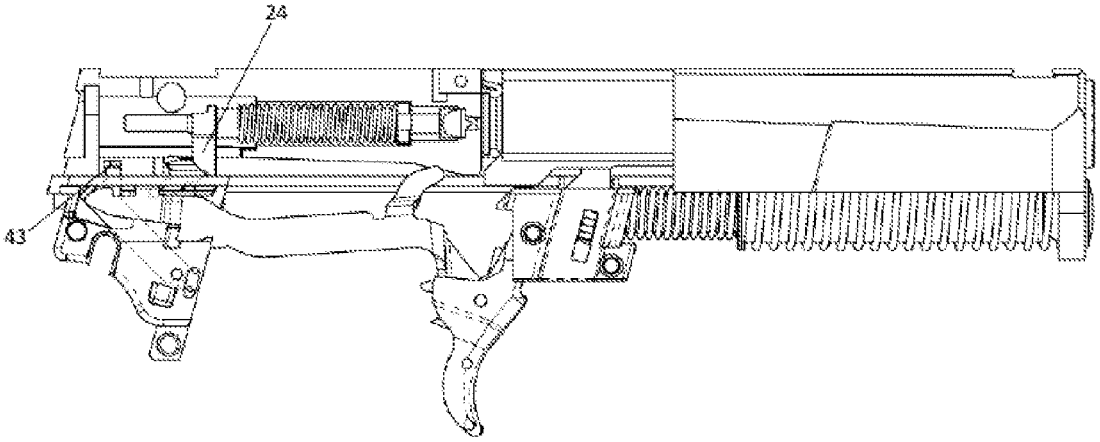

When the trigger 5 reaches the end of its path, exactly as previously disclosed, the finger 24 of the firing pin 12 loses contact with the front surface 18 of the crosswise arm 17, and is then quickly advanced by the action of the firing pin Spring 13, striking and firing the cartridge 11 located inside the chamber 9 (please refer to FIG. 26).

Figure 27:
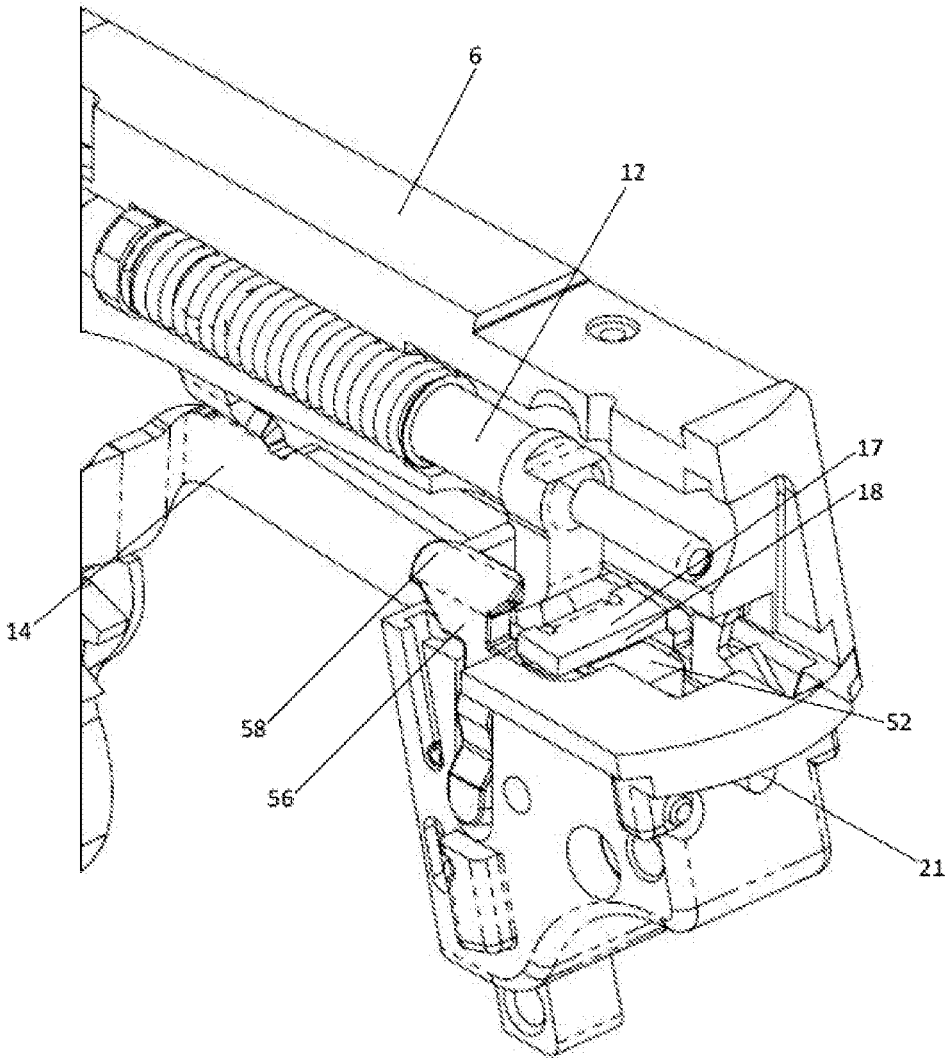

After the shot, as disclosed for the pistol 40, the bolt 6 is retracted, dragging along the firing pin 12, as shown by FIG. 27, which is a schematic end perspective view. Also in this case, the retraction of the bolt 6 causes its bolt rib 45 to act on the upper projection 44 of the disconnecting arm 43, thus displacing the rod ramp 30' inwards and allowing the elevation of the crosswise arm 17 of the rod 14. Besides this known action, the finger 24 of the firing pin 12 also interacts with the head 58 of the rod lock 51, forcing said rod lock 51 to an open position, opposed to the action of the spring 55. It is important to highlight that, due to the configuration of the head 58 of the rod lock 51, it does not impede the retraction movement of the firing pin 12, since its sides have the shape of a ramp, allowing the displacement of said head 58 towards to the outside (open position of the rod lock 51).

Figure 28:
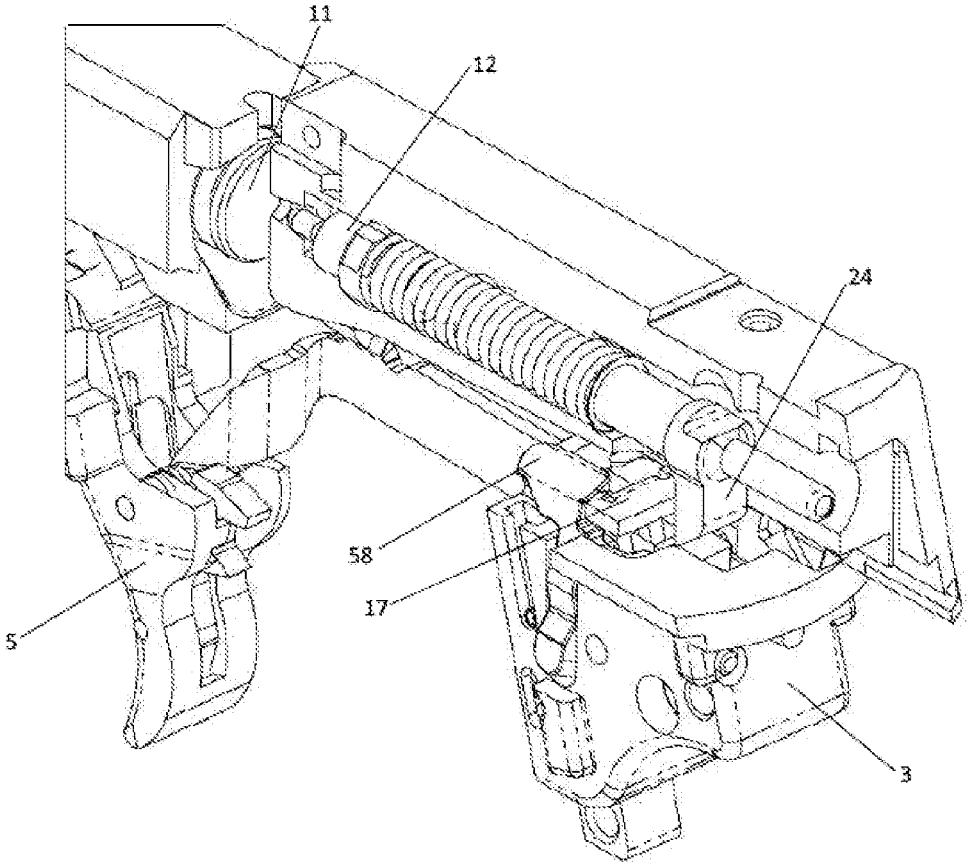

FIG. 28 is a similar view to FIG. 27, but with the lock in its maximum retraction position. After the finger 24 of the firing pin 12 passes through its region of interaction with the head 58, said firing pin loses contact and returns to the closed position, again against the action of the spring 55 acting over the internal part of the lower portion 54 of the rod lock 51. Mechanically, this position is exactly the same as already disclosed for FIG. 16 of the pistol 40, with the rod 14 with no contact with the rod ramp 30' at an upper position; furthermore, as the crosswise arm 17 is found in a closed condition, the head 58 takes the same position of the bushing 42 for the pistol 40.

From this point on, the return movement of the trigger, made step by step and progressively released by the user, is exactly the same as already disclosed for the pistol 40. Therefore, with the return of the trigger 5 and the bolt 6, the firing pin 12 moves only partially forward, since its advance movement is blocked by the front surface 18 of the rod 14 (in an upper position). Since the rod lock 51 is in closed position, the rod 14 does not move fully forwards, the device is forced to work in the SA mode and the path of the trigger is reduced (this effect is exactly the same as found when the trigger returns to the device of the pistol 40). The effect of trigger return may be shown from FIGS. 17 to 20, keeping in mind that the blocking action then made by the bushing 42 is now undertaken by the head 58 of the rod lock 51 in its closed position.

To return the pistol 50 to the DA mode of action, said key (not shown) acting on the lower portion 54 of the rod lock 51 should be pressed. More specifically, said key is located so that, when activated, it compresses the lower portion 54, thus opening the rod lock 51. With said opening, the head 58 no longer blocks the advancement of the flap 19, and therefore the firing pin 12 and the crosswise arm 17 advance to the initial displacement position. As a consequence, the rod 14 pushes the trigger 5 to its maximum extended position, which corresponds to the initial position of use in DA mode (please refer to FIG. 2). Therefore, the pistol 50 returns to the DA mode of action wherein, for a later shot, the trigger should be displaced throughout its path, i.e. since the maximum extended position until the firing position as fully pressed by the user.

Finally, if there is a percussion failure, i.e. the cartridge 11 is not fired, the backward displacement of the bolt will not occur and, for this reason, the finger 24 of the firing pin 12 will not allow the rod lock 51 to close, leaving the device in DA mode of action. As soon as the user releases the trigger and then pull it back again, the rod 14 will be able to abut the finger 24 of the firing pin 12, retracting the firing pin 12 and putting the pistol 50 in pre-shot position. Said action is possible, since the rod lock 51 is in open position and the rod 14 is in the same position as shown by FIG. 21.

From the above detailed description, we can conclude that the scope of the invention is fully reached. From a simple and efficient device (the firing device of the pistol 1 acting in DAO mode), it is possible to reach both the pistol 40 device (SA) and the pistol 50 device (DA/SA) from the inclusion of a very limited number of parts. Especially, to enable the construction of the pistol 40 from the basic device of the pistol 1, the rod ramp 30' as used additionally includes the disconnecting arm 43 and the bushing arrangement 42. In the same fashion, to build the pistol 50, the basic device of the pistol 1 is used, also with the substitution of the rod ramp 30 with the rod ramp 30' provided with the disconnecting arm 43 (this component is exactly the same as used in the pistol device 40), and also including the rod lock 51 and the stopper 52.

We can also notice that the bolt 6 as used in any of the disclosed embodiments is not changed in any way, particularly regarding the inclusion of the bolt rib 45 internally located in the flap 46. This is possible, since, in the DAO action model (pistol 1, FIGS. 1 to 10), said bolt rib 45 does not interfere with the rod ramp 30, due to the absence of the disconnecting arm 43.

Regarding the assembly line, the conception of a basic device, which can easily form three different kinds of pistols, is something innovative and highly appreciated. The standardization of components in the firing device allows quicker production, with better quality and especially more economical, bearing in mind the lower quantity of different parts to be manufactured for the assembly of different guns. Furthermore, the assembly line for guns can easily support a peak in demand for a specific model of pistol, since the vast majority of their components are identical for all models liable for production from the basic device of the present invention.

The invention claimed is:

1. A pistol firing device easily adaptable to different modes of operation, comprising a frame on top of which a bolt slides, said frame comprising a handle, which houses a magazine, a trigger guard involving a trigger and a metal back support for housing some of the components of the pistol firing device, wherein said firing device comprises said trigger pivotly mounted to a first end of a rod, wherein an end of the rod opposed to the first end is located on the back support, said bolt involves and houses a firing pin located on a rear side and aligned to a chamber wherein a cartridge is located, and said firing pin has around its front portion a firing pin spring which acts on a stop, and on a rear portion of the firing pin a finger projects downwards, said pistol firing device further comprising:

said rod in the shape of a laminar element and including, on said opposed end to the trigger, a tip and a crosswise arm, wherein said crosswise arm is projected from a longitudinal body of the rod, towards a central portion of the pistol firing device and has a front surface, able to mechanically interact with said finger and a flap facing the crosswise arm and projecting downwards, said flap comprising a central portion with an oblong hole;

a rod guiding pin fixed to the back support and with the guiding pin's crosswise axle parallel to a length of the pistol firing device, wherein said rod guiding pin crosses the oblong hole of the flap of the crosswise arm, so as to limit the upward and downward movement of said crosswise arm; and a rod ramp in the form of an elongated laminar body, fixed to a lower end of a crosswise axle and, on an opposite upper end, having a fold projecting away from a center of the pistol firing device, thus defining a contact surface that mechanically works against the tip of the rod.

2. The pistol firing device of claim 1, wherein said pistol firing device is directed to work in DAO mode.

3. The pistol firing device of claim 1, wherein said pistol firing device is directed to work in SA mode, and further comprises:

a bushing shaped as a cylinder with a central hole, and located around the rod guiding pin and upstream from the flap of the crosswise arm of the rod, so as to limit the forward movement of said rod; and a rod ramp also comprising a disconnecting arm, which is vertically projected upwards and includes, on an upper end, a projection able to mechanically interfere with a bolt rib, located in an inner side of the flap, wherein said bolt slides to displace said rod ramp inwardly in relation to the pistol firing device.

4. The pistol firing device of claim 1, wherein said pistol firing device is directed to work in DA/SA mode, and further comprises:

a rod ramp also comprising a disconnecting arm, which is vertically projected upwards and includes, on an upper end, a projection able to mechanically interfere with a bolt rib, located in an inner side of the flap, wherein said bolt slides to displace said rod ramp inwardly in relation to the pistol firing device; a rod lock with the shape of a hinge to a respective axle located parallel to the crosswise axle of the pistol firing device and defining:

a lower portion of the rod lock, having an outer surface able to be acted on by a key as well as a spring, located inside said lower portion in order to constantly push the lower portion out; and an upper portion of the rod lock, comprising an arm extending parallel to an axle of the rod lock, as well as a head located on a upper end of said rod lock; and a stopper, basically in the form of a cube, provided with a central hole through which said stopper is assembled over the rod guiding pin in a position between the flap of the crosswise arm of the rod and a spring located around the rod guiding pin.

* * * * *